US011142444B2

(12) United States Patent
Bachmann et al.

(10) Patent No.: US 11,142,444 B2
(45) Date of Patent: Oct. 12, 2021

(54) REFRIGERATED DISPENSER CONVERSION SYSTEM

(71) Applicant: Wandering Bear Inc., New York, NY (US)

(72) Inventors: Matthew Bachmann, New York, NY (US); Benjamin Gordon, New York, NY (US); David Finger, New York, NY (US)

(73) Assignee: WANDERING BEAR INC., New York, NY (US)

( * ) Notice: Subject to any disclaimer, the term of this patent is extended or adjusted under 35 U.S.C. 154(b) by 0 days.

(21) Appl. No.: 16/810,035

(22) Filed: Mar. 5, 2020

(65) Prior Publication Data

US 2021/0276854 A1 Sep. 9, 2021

(51) Int. Cl.

| | |
|---|---|
| ***B67D 1/08*** | (2006.01) |
| ***B67D 1/10*** | (2006.01) |
| ***B67D 1/00*** | (2006.01) |

(52) U.S. Cl.

CPC ..... *B67D 1/0841* (2013.01); *B67D 1/0004* (2013.01); *B67D 1/10* (2013.01); *B67D 2001/0097* (2013.01); *B67D 2210/00036* (2013.01)

(58) Field of Classification Search

CPC ..... B67D 1/0841; B67D 1/0004; B67D 2001/0097; B67D 2210/00036

See application file for complete search history.

(56) References Cited

U.S. PATENT DOCUMENTS

| | | | | |
|---|---|---|---|---|
| 4,957,220 | A | 9/1990 | Du | |
| 5,575,405 | A | 11/1996 | Stratton et al. | |
| 6,142,340 | A | 11/2000 | Watanabe et al. | |
| 6,189,736 | B1 | 2/2001 | Phallen | |
| 7,077,293 | B2 * | 7/2006 | McCann | B67D 1/0021 222/129.1 |
| 7,080,525 | B2 * | 7/2006 | McCann | B67D 1/0021 222/146.6 |
| 7,555,980 | B2 | 7/2009 | Howard et al. | |

(Continued)

FOREIGN PATENT DOCUMENTS

| | | |
|---|---|---|
| WO | 9627317 | 9/1996 |
| WO | 2017160193 | 9/2017 |

*Primary Examiner* — Jeremy Carroll

(74) *Attorney, Agent, or Firm* — Rankin, Hill & Clark LLP

(57) ABSTRACT

A refrigerated beverage dispenser conversion system includes an electric pump configured for being mounted within an interior of a refrigerated beverage dispenser, the electric pump having an inlet and an outlet. An inlet barb is operatively connected to the electric pump at the inlet, and an inlet hose is operatively connected to the inlet barb at a first end of the inlet hose. The inlet barb and the inlet hose are sized to engage an outlet of a container disposed within the refrigerated beverage dispenser to bring the container in fluid communication with the electric pump. An outlet barb is operatively connected to the electric pump at the outlet and sized for operatively connecting to an outlet hose in fluid communication with an outlet of the refrigerated beverage dispenser. The outlet barb is differently sized from the inlet barb, such that the refrigerated beverage dispenser conversion system is configured to bring the container in fluid communication with the outlet of the refrigerated beverage dispenser.

13 Claims, 7 Drawing Sheets

(56) References Cited

U.S. PATENT DOCUMENTS

| | | | | |
|---|---|---|---|---|
| 9,926,182 | B2 | 3/2018 | Santy | |
| 2003/0066306 | A1* | 4/2003 | Renken | B67D 1/0861 62/390 |
| 2015/0048116 | A1 | 2/2015 | Orita | |
| 2017/0240399 | A1* | 8/2017 | Blank | F25D 31/002 |
| 2018/0186617 | A1 | 7/2018 | Cocchi et al. | |

* cited by examiner

REFRIGERATED DISPENSER CONVERSION SYSTEM

BACKGROUND

Refrigerated beverage dispensers, such as kegerators, that are designed to house and dispense contents from pressurized beverage containers are narrow use devices that often outlive their original purpose. Typically, refrigerated beverage dispensers are designed to rely on an elevated internal pressure beverage containers, such as plastic or steel kegs, which are pressurized by cylinders of nitrogen or carbon dioxide gas to dispense contents of a beverage container from a relatively elevated outlet of the refrigerated beverage dispenser. As a result, refrigerated beverage dispensers typically cannot dispense beverages from containers lacking an elevated internal pressure and/or incapable of achieving such pressure. Furthermore, refrigerated beverage dispensers, such as kegerators, are typically designed to operatively connect the outlet of the refrigerated beverage dispenser only to a narrow variety of container outlets, such as keg couplers. As a result, refrigerated beverage dispensers typically lack the hardware necessary to operatively connect the outlet of the refrigerated beverage dispenser to a beverage container that falls outside the intended use of the refrigerated beverage container.

Consequently, owners of refrigerated beverage dispensers that are interested in dispensing non-carbonated beverages such as coffee conveniently from a refrigerated container without using a pressurized delivery system are prompted to convert the refrigerated beverage container with adaptive hardware, or invest in a separate apparatus altogether.

SUMMARY

According to one aspect, a refrigerated beverage dispenser conversion system includes an electric pump configured for being mounted within an interior of a refrigerated beverage dispenser, the electric pump having an inlet and an outlet. An inlet barb is operatively connected to the electric pump at the inlet, and an inlet hose is operatively connected to the inlet barb at a first end of the inlet hose. The inlet barb and the inlet hose are sized to engage an outlet of a container disposed within the refrigerated beverage dispenser to bring the container in fluid communication with the electric pump. An outlet barb is operatively connected to the electric pump at the outlet and sized for operatively connecting to an outlet hose in fluid communication with an outlet of the refrigerated beverage dispenser. The outlet barb is differently sized from the inlet barb, such that the refrigerated beverage dispenser conversion system is configured to bring the container in fluid communication with the preexisting, pre-installed outlet of the refrigerated beverage dispenser.

According to another aspect, a method of converting a refrigerated beverage dispenser includes locating an electric pump, an inlet barb connected with an inlet of the electric pump, and an inlet hose connected to the inlet barb at a first end of the inlet hose within an interior of a refrigerated beverage dispenser. The method also includes operatively connecting a second end of the inlet hose with an outlet fitting of a bag-in-box container holding a non-carbonated beverage such that the bag-in-box container is in fluid communication with the electric pump. The method also includes operatively connecting an outlet hose in fluid communication with the preexisting, pre-installed outlet of the refrigerated beverage dispenser located external to the refrigerated beverage dispenser with an outlet of the electric pump, thereby bringing the bag-in-box container in fluid communication with the outlet of the refrigerated beverage dispenser.

According to another aspect, a method of configuring an electric pump system for converting a refrigerated beverage dispenser includes operatively connecting a first end of an inlet hose to an inlet barb, and operatively connecting an electric pump with the inlet barb at an inlet of the electric pump. The inlet barb and the inlet hose are sized to fit an outlet of a container and thereby bring the container in fluid communication with the electric pump. The method also includes operatively connecting a second end of the inlet hose with a quick connect spear configured for engaging the outlet of the container, and operatively connecting the electric pump with an outlet barb at an outlet of the electric pump. The outlet barb is sized to fit an outlet hose in fluid communication with the preexisting, pre-installed outlet of the refrigerated beverage dispenser located external to the refrigerated beverage dispenser, wherein the inlet barb and the outlet barb are different sizes.

DETAILED DESCRIPTION

Figure 1:
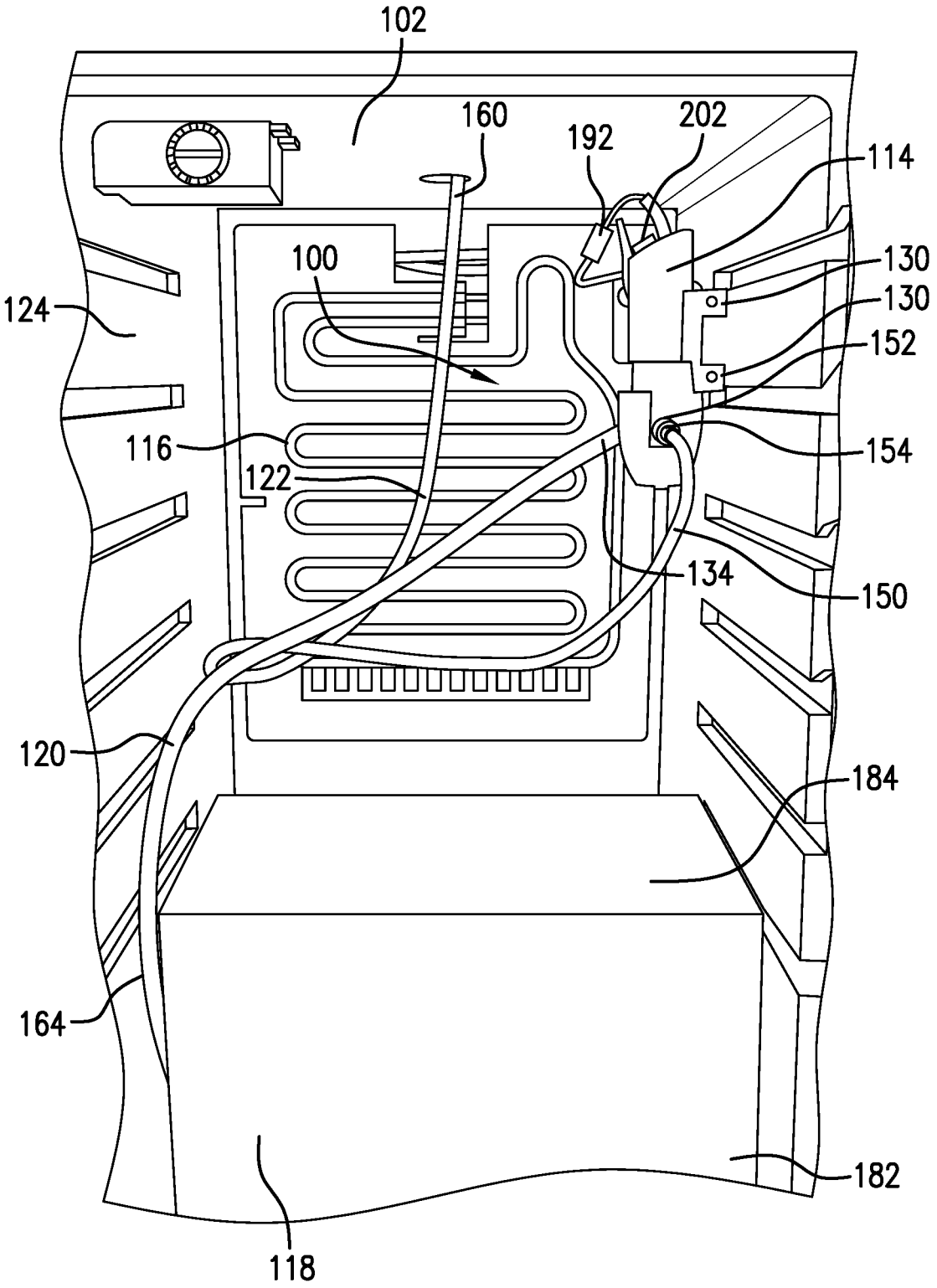
FIG. 1 is a front view of an exemplary refrigerated beverage dispenser conversion system installed in an exemplary refrigerated beverage dispenser.
Figure 2:
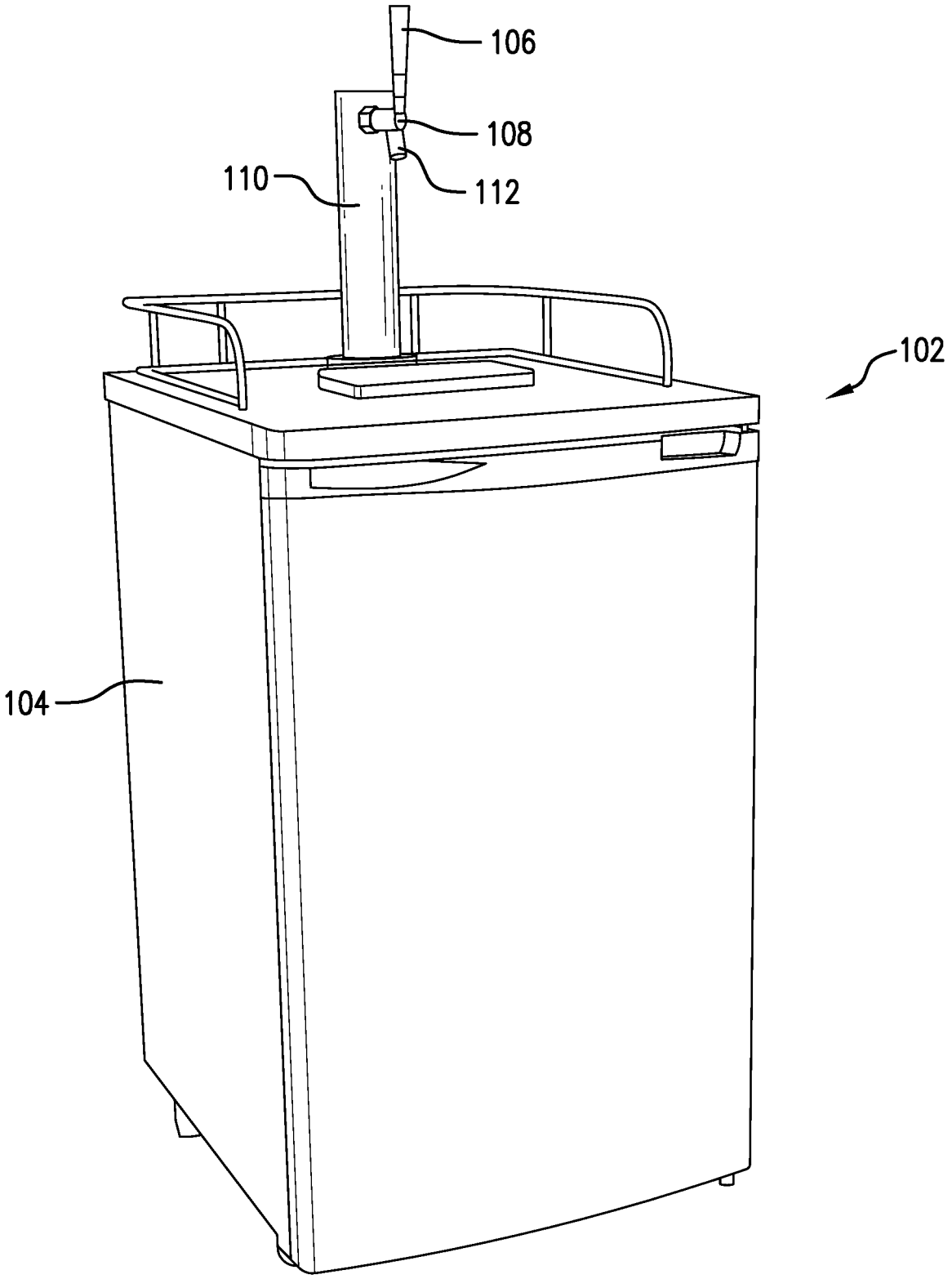
FIG. 2 is a front perspective view of the exemplary refrigerated beverage dispense.

It should, of course, be understood that the description and drawings herein are merely illustrative and that various modifications and changes can be made in the structures disclosed without departing from the present disclosure. Referring now to the drawings, wherein like numerals refer to like parts throughout the several views, FIG. 1 illustrates a refrigerated beverage dispenser conversion system 100 assembled and installed in a refrigerated beverage dispenser 102, which is a kegerator. With reference to FIG. 2, a kegerator is known in the art as including a small refrigerator 104 designed or adapted to hold a keg from which cold beer can be dispensed. The kegerator includes a tap handle 106, a faucet 108 and a draft tower 110 mounted on an exterior of the refrigerator 104. The faucet 108 includes the outlet 112 for the kegerator.

With reference back to FIG. 1, the conversion system 100 includes an electric pump 114 located within an interior 116 of the refrigerated beverage dispenser 102, in fluid communication with a container 118 through an inlet hose 120, and in fluid communication with the outlet 112 (FIG. 2) of the refrigerated beverage dispenser 102 through an outlet hose 122. The electric pump 114 is installed on an interior wall 124 of the refrigerator 104 by driving screws through mounting flanges 130 extending from the electric pump 114, the mounting flanges 130 guiding the screws into the interior wall 124 as the screws are driven through the mounting flanges 130.

Figure 3:
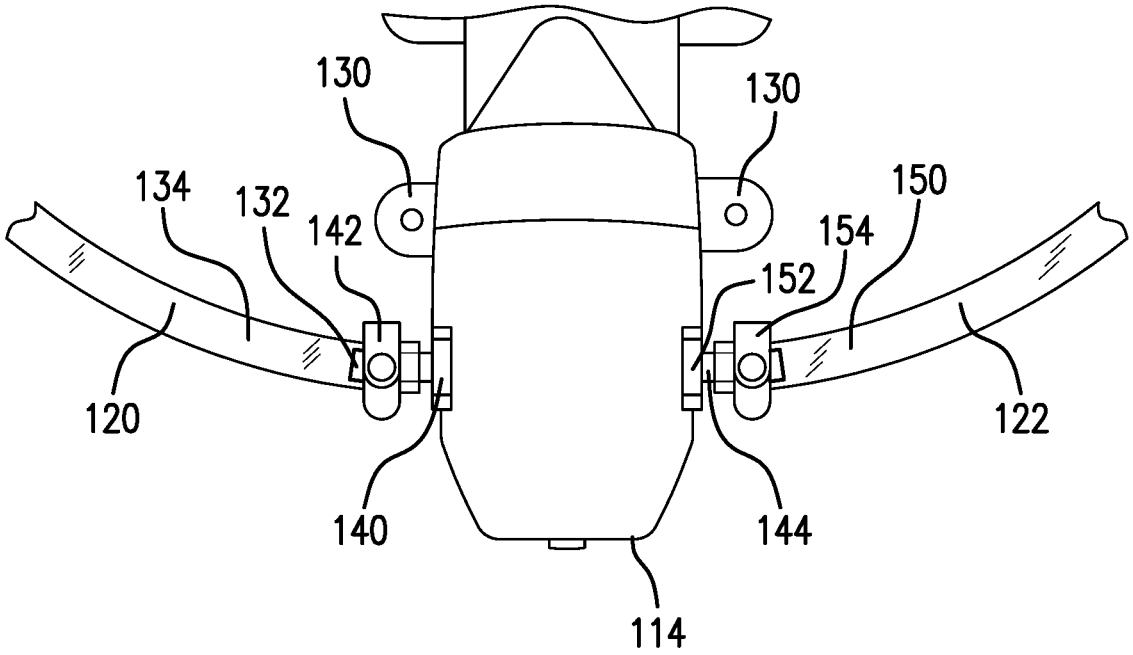
FIG. 3 is a partial front view of the refrigerated beverage dispenser conversion system including an electric pump operatively connected to an inlet hose and an outlet hose.

As depicted in FIG. 3, the inlet hose 120 is operatively connected to the electric pump 114 through an inlet barb 132. The inlet barb 132 connects a first end 134 of the inlet hose 120 and an inlet 140 of the electric pump 114, and is fastened to the inlet hose 120 with a first clamp 142. In fastening the inlet barb 132, the first clamp 142 is placed over the first end 134 of the inlet hose 120 where the inlet hose 120 connects with the inlet barb 132, and tightened to secure the inlet hose 120 to the inlet barb 132.

The outlet hose 122 is operatively connected to the electric pump 114 through an outlet barb 144. As depicted, the outlet barb 144 connects a first end 150 of the outlet hose 122 and an outlet 152 of the electric pump 114, and is fastened to the outlet hose 122 with a second clamp 154. In fastening the outlet barb 144, the second clamp 154 is placed over the first end 150 of the outlet hose 122, and tightened over the outlet hose 122 where the outlet hose 122 connects with the outlet barb 144. The outlet hose 122 is in fluid communication with the outlet 112 of the refrigerated beverage dispenser 102 located external to the refrigerator 104 at a second end 160 of the outlet hose 122. The outlet hose 122 can be the hose, often referred to as a "beer line," provided by the manufacturer of the kegerator. This hose can be connected with the draft tower 110 upon receipt of the kegerator from the manufacturer or retailer.

Figure 4:
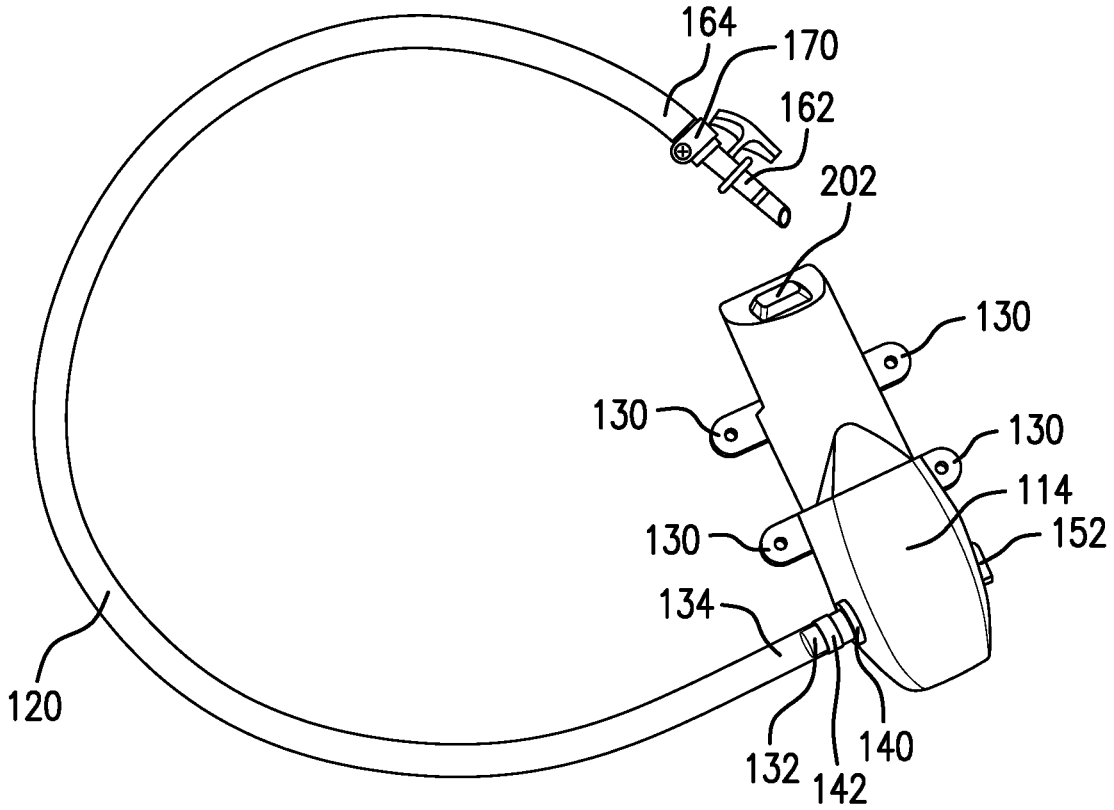
FIG. 4 is a top view of the refrigerated beverage dispenser conversion system including an electric pump, an inlet barb, and an inlet hose connected with each other.
Figure 6:
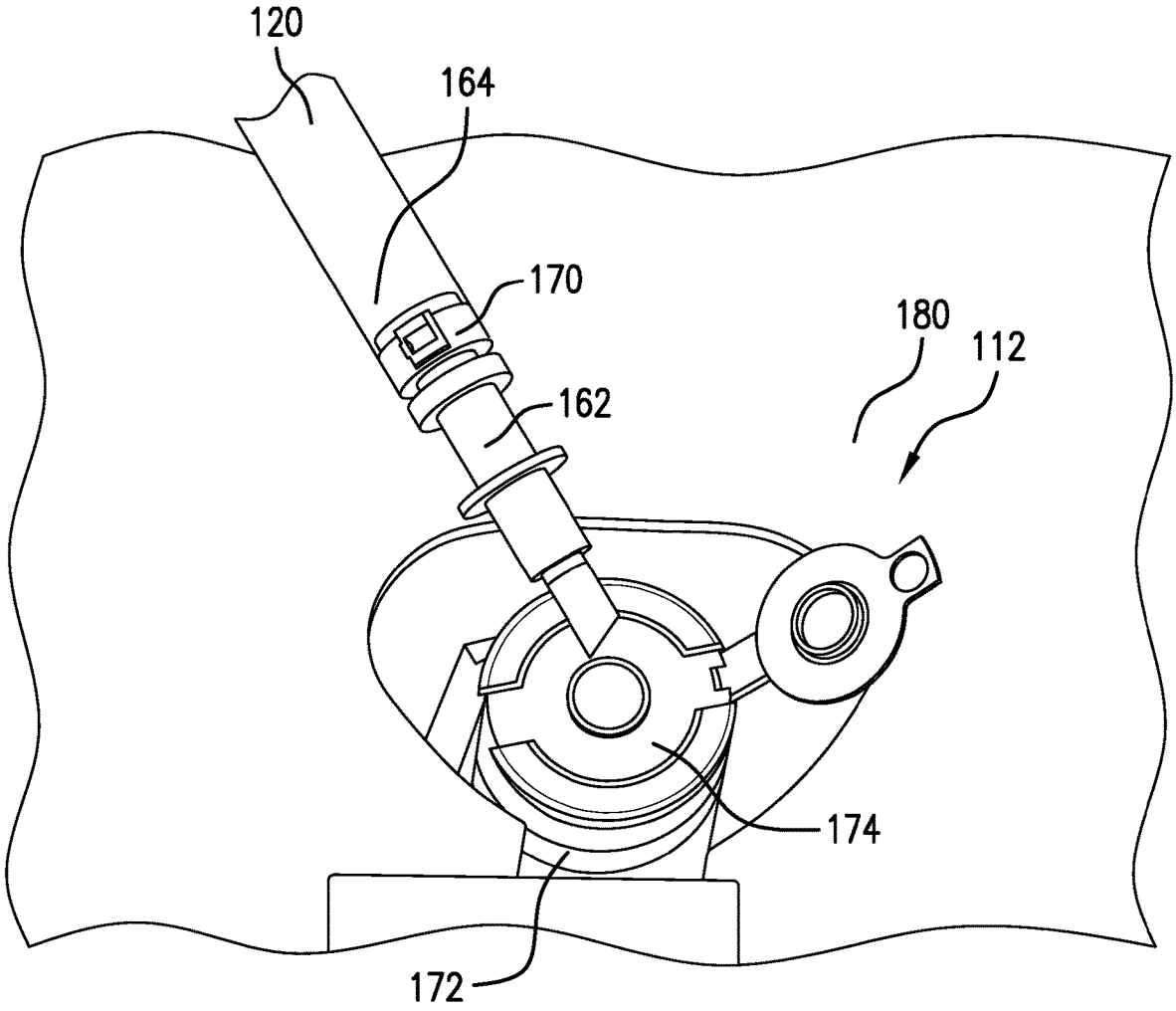
FIG. 6 is a partial view of the refrigerated beverage dispenser conversion system including a quick connect spear positioned with an outlet fitting of a container.
Figure 7:
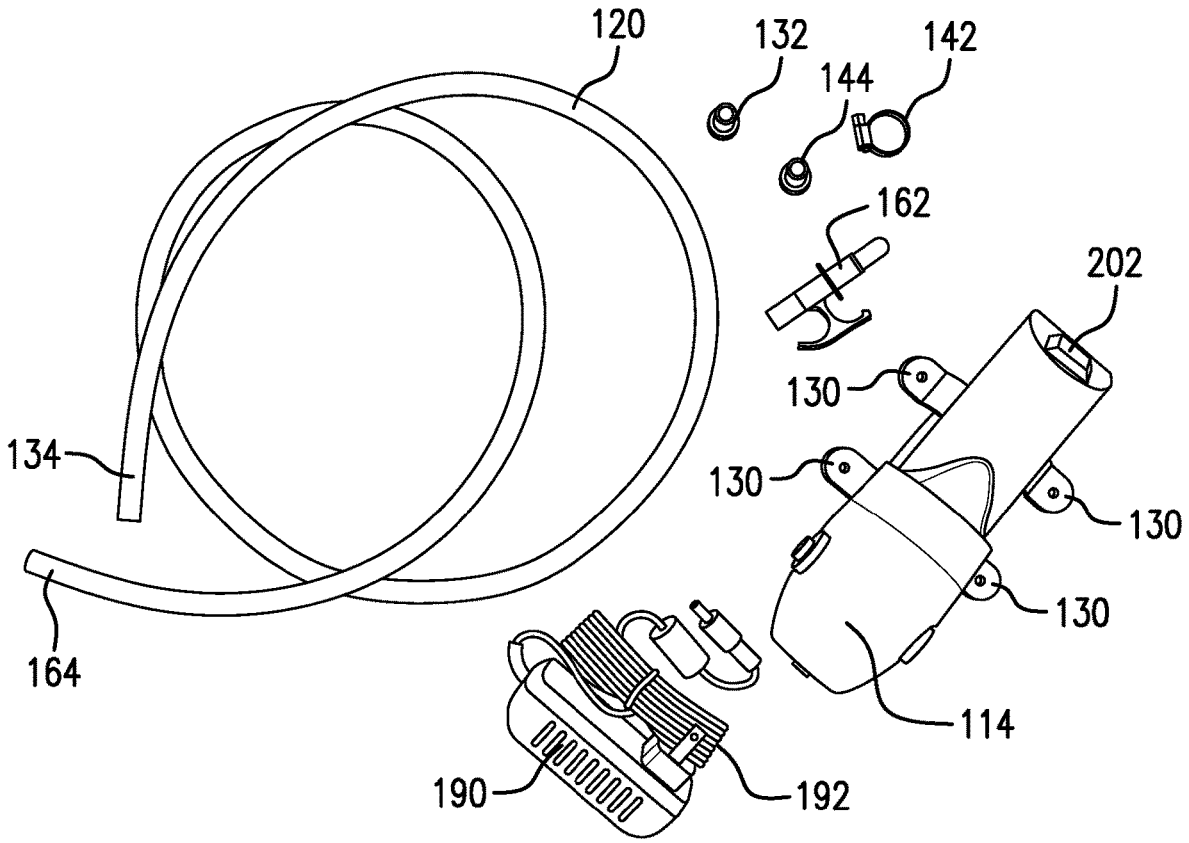
FIG. 7 is a top view of the refrigerated beverage dispenser conversion system, disassembled.

As depicted in FIG. 4, a quick connect spear 162 is operatively connected to a second end 164 of the inlet hose 120. Specifically, the quick connect spear 162 is inserted into a second end 164 of the inlet hose 120, and a third clamp 170 is tightened over the second end 164 of the inlet hose 120 where the inlet hose 120 covers the quick connect spear 162, fixing the first end 134 of the inlet hose 120 to the quick connect spear 162. With reference to FIG. 6, the quick connect spear 162 is a male connector configured for engaging an outlet 172 of the container 118 such that the quick connect spear 162 is received in an outlet fitting 174 at the outlet 172 of the container 118, connecting the container 118 in fluid communication with the inlet hose 120.

The inlet barb 132, inlet hose 120, and quick connect spear 162 are sized to adapt the inlet 140 of the electric pump 114 to the outlet 172 of the container 118, while the outlet barb 144 is sized to adapt the outlet 152 of the electric pump 114 to the outlet hose 122 of the refrigerated beverage dispenser 102. Additionally, the inlet 140 of the electric pump 114 and the outlet 152 of the electric pump 114 are respectively sized according to the outlet 172 of the container 118 and the outlet hose 122 of the refrigerated beverage dispenser 102. Consequently, the inlet barb 132 and the outlet barb 144 have different internal diameters, and the inlet hose 120 and outlet hose 122 have different internal diameters. In this manner, each element cooperatively brings the outlet 172 of the container 118 in fluid communication with the outlet 112 of the refrigerated beverage dispenser 102 across the electric pump 114. In an embodiment, the inlet barb 132 is smaller in internal diameter than the outlet barb 144, and the inlet hose 120 is smaller in internal diameter than the outlet hose 122.

As depicted in FIG. 1, the container 118 is a bag-in-box container and oriented in the interior 116 of the refrigerator 104 such that the outlet 172 of the container is located on a side 180 (FIG. 5) near a bottom of the container 118. In this manner, the inlet hose 120 connects near the bottom of the container 118 such that the conversion system 100 is gravity assisted, wherein gravity directs contents of the container 118 toward the outlet 172 of the container 118 until the container 118 is empty.

As depicted, the electric pump 114 is mounted above the container 118, such that a top surface 184 opposite from the bottom of the container 118 faces the electric pump 114. To accommodate disparate locations and angles of the outlet 152 of the electric pump 114 and the outlet 172 of the container, the inlet hose 120 is sufficiently flexible to be maneuvered around the container 118 from the electric pump 114.

The electric pump 114 receives power from a power adapter 190 depicted in FIG. 6. The power adapter 190 provides the electric pump 114 power through a cord 192 threaded through an aperture 194 (FIG. 5) defined in the interior wall 124. The aperture 194 can be an existing hole in the refrigerator 104 through which a gas line, which would typically connect with a $CO_2$ or nitrogen tank, would thread through. The cord 192 can exit the interior 116 of the refrigerator 104 in other manners.

The electric pump 114 is configured such that actuation of the tap handle 106 from an off position to a dispensing position actuates the electric pump 114 to deliver contents from the container 118 to the outlet 112 of the refrigerated beverage dispenser 102. With the electric pump 114 configured for pumping contents of the container 118, and the container 118 being gravity assisted, the refrigerated beverage dispenser 102 does not require pressurized tanks, including the nitrogen tank or carbon dioxide tank mentioned above, to draw contents from the container 118 to the outlet 112 of the refrigerated beverage dispenser 102.

Assembling the conversion system 100 as in FIG. 4 includes inserting the inlet barb 132 into the first end 134 of the inlet hose 120 and fastening the inlet hose 120 with respect to the inlet barb 132 with the first clamp 142. To this end, the first clamp 142 is placed over the first end 134 of the inlet hose 120 at a section of the inlet hose 120 where the inlet hose 120 connects with the inlet barb 132, and tightened to secure the inlet hose 120 to the inlet barb 132.

The quick connect spear 162 is inserted into the second end 164 of the inlet hose 120 and the inlet hose 120 is fastened around the quick connect spear 162 with the third clamp 170, operatively connecting the quick connect spear 162 to the second end 164 of the inlet hose 120. The quick connect spear 162 is connected to the second end 164 of the inlet hose 120 prior to connecting the inlet hose 120 with the container 118. The inlet barb 132 is operatively connected to the electric pump 114 at the inlet 140 of the electric pump 114, bringing the inlet hose 120 in fluid communication with the electric pump 114.

Figure 5:
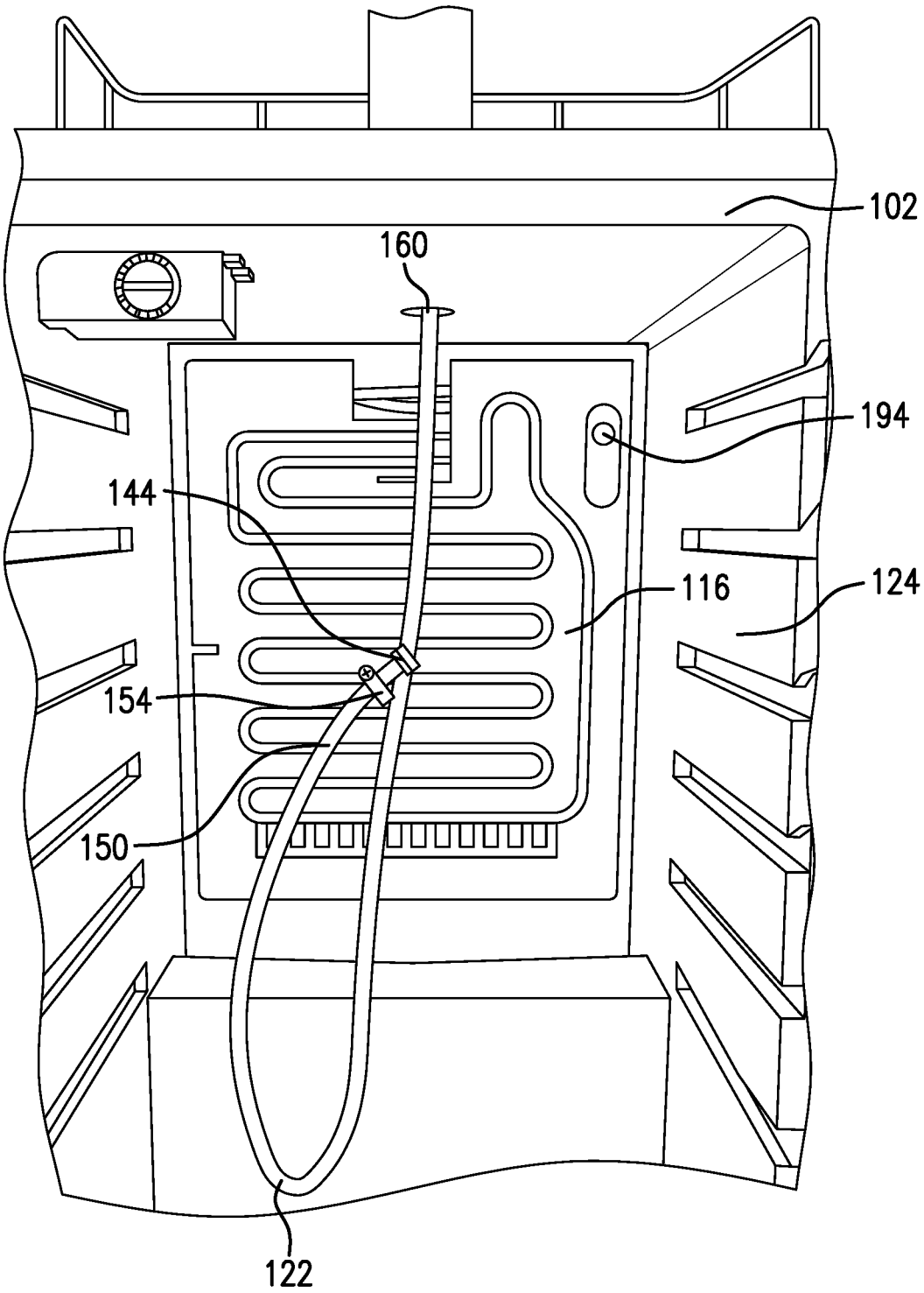
FIG. 5 is a partial front view of the refrigerated beverage dispenser and an outlet hose of the refrigerated beverage dispenser operatively connected to an outlet barb of the refrigerated beverage dispenser conversion system.

Installing the conversion system 100 in the refrigerated beverage dispenser 102 includes connecting the outlet barb 144 to the outlet hose 122 by inserting the outlet barb 144 into the first end 150 of the outlet hose 122 as in FIG. 5, and fastening the outlet hose 122 with respect to the outlet barb 144 with the second clamp 154. As mentioned above, the outlet hose 122 can be the hose, often referred to as a "beer line," provided by the manufacturer or retailer of the kegerator. Alternatively, the outlet hose 122 can be provided with the conversion system 100 and connect to the faucet 108 through the draft tower 110. The second clamp 154 is placed around the first end 150 of the outlet hose 122 where the outlet hose 122 connects with the outlet barb 144, and is tightened to secure the outlet hose 122 to the outlet barb 144. As depicted in FIG. 3, the outlet barb 144 is fitted into the outlet 152 of the electric pump 114, bringing the outlet hose 122 in fluid communication with the electric pump 114. In this manner, the outlet hose 122 is operatively connected with the outlet 112 of the refrigerated beverage dispenser 102 with the outlet 152 of the electric pump 114, thereby bringing the container 118 in fluid communication with the outlet 112 of the refrigerated beverage dispenser 102. In an embodiment, the outlet barb 144 is connected with the electric pump 114 prior to the electric pump 114 being placed in the refrigerated beverage dispenser 102, and the outlet barb 144 is connected to the outlet hose 122 prior to being fitted into the outlet 152 of the electric pump 114.

With the conversion system 100 assembled and installed in the refrigerated beverage dispenser 102 as in FIGS. 2-4, the electric pump 114, inlet barb 132, inlet hose 120, and quick connect spear 162 are located in the interior 116 of the refrigerated beverage dispenser 102 as in FIG. 1. The electric pump 114, inlet barb 132, and inlet hose 120 can be connected with each other prior to being placed within the interior 116 of the refrigerator 104. The quick connect spear 162, which is connected to the second end 164 of the inlet hose 120, engages the outlet fitting 174 of the container 118 such that the inlet hose 120 is in fluid communication with the container 118. The cord 192 of the power adapter 190 is threaded through the aperture 194, the electric pump 114 is operatively connected to the tap handle, and the electric pump 114 is mounted to the interior wall 124 of the refrigerated beverage dispenser 102.

The electric pump 114 is mounted to the interior wall 124 of the refrigerated beverage dispenser 102 by driving screws through the mounting flanges 130 and into the interior wall 124 of the refrigerated beverage dispenser 102. As depicted, the electric pump 114 is mounted above the container 118, with the container 118 disposed in the interior 116 of the refrigerated beverage dispenser 102 such that the outlet 172 of the container 118 is directed downwards from the side 180 of the container 118, or most bottom point of the container 118. With this orientation and location of the outlet 172 of the container 118 with respect to the container 118, gravity directs contents of the container 118 toward the outlet fitting 174 until the container 118 is empty.

With the conversion system 100 assembled and installed into the refrigerated beverage dispenser 102 as in FIG. 1, the electric pump 114 is turned on by actuating a button 202 located on the electric pump 114. When the electric pump 114 is turned on, the electric pump 114 is configured to pump contents of the container 118 from the container 118 to the outlet 112 of the refrigerated beverage dispenser 102 when the tap handle is disposed in the dispensing position.

It will be appreciated that various embodiments of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method of converting a refrigerated beverage dispenser, the method comprising:

locating an electric pump, an inlet barb connected with an inlet of the electric pump, and an inlet hose connected to the inlet barb at a first end of the inlet hose within an interior of a refrigerated beverage dispenser;

operatively connecting a second end of the inlet hose with an outlet fitting of a bag-in-box container holding a non-carbonated beverage such that the container is in fluid communication with the electric pump;

operatively connecting an outlet hose in fluid communication with an outlet of the refrigerated beverage dispenser located external to the refrigerated beverage dispenser with an outlet of the electric pump, thereby bringing the bag-in-box container in fluid communication with the outlet of the refrigerated beverage dispenser.

2. The method of claim 1, wherein the electric pump, the inlet barb, and the inlet hose are connected with each other prior to placing the electric pump, the inlet barb, and the inlet hose within the interior of the refrigerated beverage dispenser.

3. The method of claim 2, wherein the outlet hose has a different internal diameter than the inlet hose.

4. The method of claim 1, further comprising connecting an outlet barb to the outlet hose and fitting the outlet barb in the outlet of the electric pump to bring the outlet hose in fluid communication with the electric pump, the outlet barb having a different internal diameter than the inlet barb.

5. The method of claim 4, wherein the outlet barb is connected with the electric pump prior to placing the electric pump in the refrigerated beverage dispenser.

6. The method of claim 4, wherein connecting the outlet barb to the outlet hose is performed prior to fitting the outlet barb in the outlet of the electric pump.

7. The method of claim 6, wherein the refrigerated beverage dispenser is a kegerator having a tap handle mounted to a draft tower external to a refrigerator, and the outlet hose is connected with the draft tower upon receipt of the kegerator from a manufacturer or retailer of the kegerator.

8. The method of claim 1, wherein the refrigerated beverage dispenser is a kegerator having a tap handle located external to refrigerator, the electric pump being configured such that actuating the tap handle from an off position to a dispensing position actuates the electric pump to deliver non-carbonated beverage from the container toward the outlet.

9. The method of claim 8, further comprising connecting a power cord to the electric pump and threading the power cord through an existing aperture provided in a wall of the refrigerator.

10. The method of claim 1, wherein operatively connecting the second end of the inlet hose with the outlet fitting of the container includes operatively connecting the second end of the inlet hose near a bottom of the container, such that gravity directs contents of the container toward the outlet fitting of the container.

11. The method of claim 1, further comprising inserting a quick connect spear connected to the second end of the inlet hose prior to connecting the inlet hose with the container, and engaging the quick connect spear with the outlet of the container so as to connect the inlet hose with the container.

12. The method of claim 1, wherein operatively connecting the inlet barb to the inlet hose includes placing a clamp over the inlet hose at a section of the inlet hose where the inlet hose connects with the inlet barb.

13. The method of claim 1, wherein operatively connecting the second end of the inlet hose with the outlet of the container includes operatively connecting the second end of the inlet hose to a side of the container located opposite from a side of the container facing the electric pump.

* * * * *